United States Patent [19]

Frick et al.

[11] 4,366,863

[45] Jan. 4, 1983

[54] ENHANCED OIL RECOVERY OPERATIONS

[75] Inventors: Robert J. Frick, Houston; Ralph J. Korstad, Austin; Charles J. Robinson, III, Katy, all of Tex.

[73] Assignee: Texaco Inc., White Plains, N.Y.

[21] Appl. No.: 191,975

[22] Filed: Sep. 29, 1980

[51] Int. Cl.[3] ..... E21B 43/30

[52] U.S. Cl. ..... 166/245

[58] Field of Search ..... 166/245, 268

[56] References Cited

U.S. PATENT DOCUMENTS

| | | | |
|---|---|---|---|
| 3,167,117 | 1/1965 | Santourian | 166/245 |
| 3,333,633 | 8/1967 | Greenkorn | 166/245 |
| 3,517,744 | 6/1970 | Horton | 166/245 |
| 3,794,113 | 2/1974 | Strange | 166/245 |
| 3,905,422 | 9/1975 | Woodward | 166/245 |

*Primary Examiner*—William F. Pate, III

*Attorney, Agent, or Firm*—Robert A. Kulason; Jack H. Park

[57] ABSTRACT

In an enhanced oil recovery process utilizing a plurality of wells disposed in a nearly square grid wherein a plurality of these wells are injection wells which are utilized to inject a fluid into a petroleum reservoir, said fluid being then forced through the reservoir towards a plurality of production wells from which the fluid and mobilized petroleum from the reservoir are produced, an improvement is added comprising utilizing the wells at the corners of each nearly square grid as injection wells, drilling two additional wells within each grid along one diagonal and then utilizing these two additional wells as new production wells.

4 Claims, 2 Drawing Figures

ENHANCED OIL RECOVERY OPERATIONS

BACKGROUND OF THE INVENTION

1. Field of the Invention

This invention relates to enhanced oil recovery processes wherein one or more fluids are injected into a subterranean petroleum reservoir for the purpose of mobilizing and driving the petroleum liquids contained therein towards production wells. More particularly, this invention relates to an improved well pattern for the location of these injection and production wells.

2. Description of the Prior Art

The development of different well patterns for petroleum recovery operations has reached a relatively sophisticated level. Perhaps the simplest is the square grid pattern which is initially employed during the primary recovery operation stage in the development of the oil field wherein all of the wells are utilized as producing wells. Then, during secondary recovery operations, some of the producing wells are converted into water injection wells for the purpose of recovering more petroleum from the reservoir. However, well pattern development has not stopped with the square grid pattern. Other common well patterns include the five spot pattern in which a central producing well is located within each individual grid of the square grid array with injection wells on the corners of the square. Other patterns include inverted five spot, the nine spot in which the central well is an injection well with the producing wells located on the corners, offset lines, and a host of others. Each of these individual systems can be further developed by switching wells within the pattern from in injection mode to a production mode and vice versa. Furthermore, individual wells within each pattern can be shut in. Each variation is employed for the purpose of increasing the areal sweep efficiency of the pattern. This areal sweep efficiency is a measure of the area actually swept by fluids injected through the injections wells which then flow through the formation and are produced from the production wells. In relation to the total area bounded by the well pattern, this areal sweep efficiency is measured in the horizontal plane and is usually expressed as a percentage. U.S. Pat. Nos. 3,845,817, 3,882,922, 3,874,449 and 3,877,521 to Altamira and Hoyt are representative references.

However, most if not all of the developments in this area have been directed towards improving only the areal sweep efficiency. To do so is to neglect other important factors such as vertical sweep efficiency, which can play a very important role in the overall effectiveness of a given enhanced oil recovery operation. Vertical sweep efficiency measures the areas swept within a formation as a function of the total vertical cross section of the producing interval, and is measured in a vertical rather than a horizontal plane. Such a measurement becomes quite critical in situations where the petroleum sought to be recovered, such as heavy oils and the bitumen contained in tar sands, is swept by fluids of a much lower specific gravity such as water, steam or hydrocarbon gases, carbon dioxide or other such fluids. Steam injection programs are particularly troublesome in this respect because the steam tends to rise immediately to the top of the producing interval, producing a condition known as override. The steam will commonly preferentially flow through this override channel to the production well, leaving the majority of the producing interval unswept. This steam override effect produces quite low vertical sweep efficiencies and therefore low efficiencies for the enhanced oil recovery system as a whole. Typical references addressed to this problem are U.S. Pat. Nos. 4,166,501; 4,166,502; 4,166,503; 4,166,504; 4,177,752 and pending application Ser. No. 141,243 filed Apr. 17, 1980. Nevertheless, there remains a long felt need in the art for an improved well pattern, which can produce both a high areal sweep efficiency and a high vertical sweep efficiency.

SUMMARY OF THE INVENTION

In an enhanced oil recovery process utilizing a plurality of wells disposed in nearly square grid wherein a plurality of the wells are utilized as injection wells to inject a fluid into a petroleum reservoir, said fluid being then forced through the reservoir towards a plurality of production wells from which the fluid and mobilized petroleum from the reservoir are produced, the improvement is added comprising utilizing the wells at the corners of each nearly square grid unit as injection wells, drilling two additional wells within each grid unit along one diagonal and utilizing these two additional wells as new production wells.

DESCRIPTION OF THE PREFERRED EMBODIMENT

Figure 1:
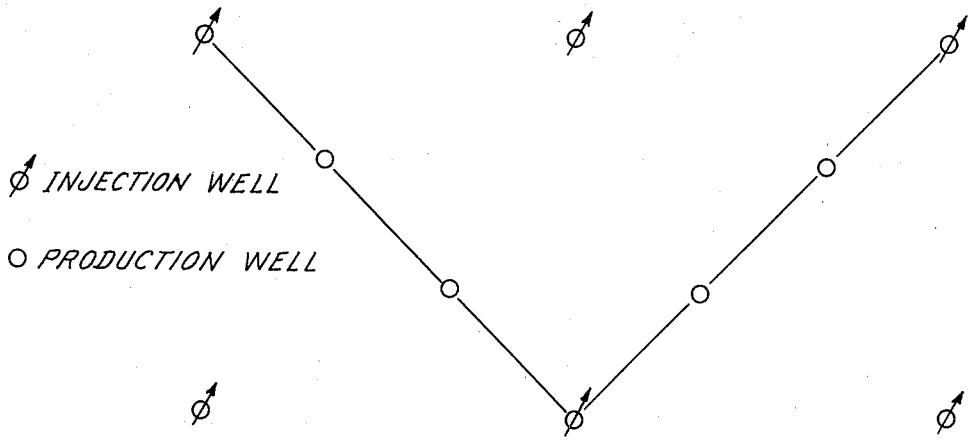
FIG. 1 portrays in plan view one square grid unit within the larger square grid pattern wherein the two additional wells have been drilled along one diagonal and are utilized as production wells.
Figure 2:
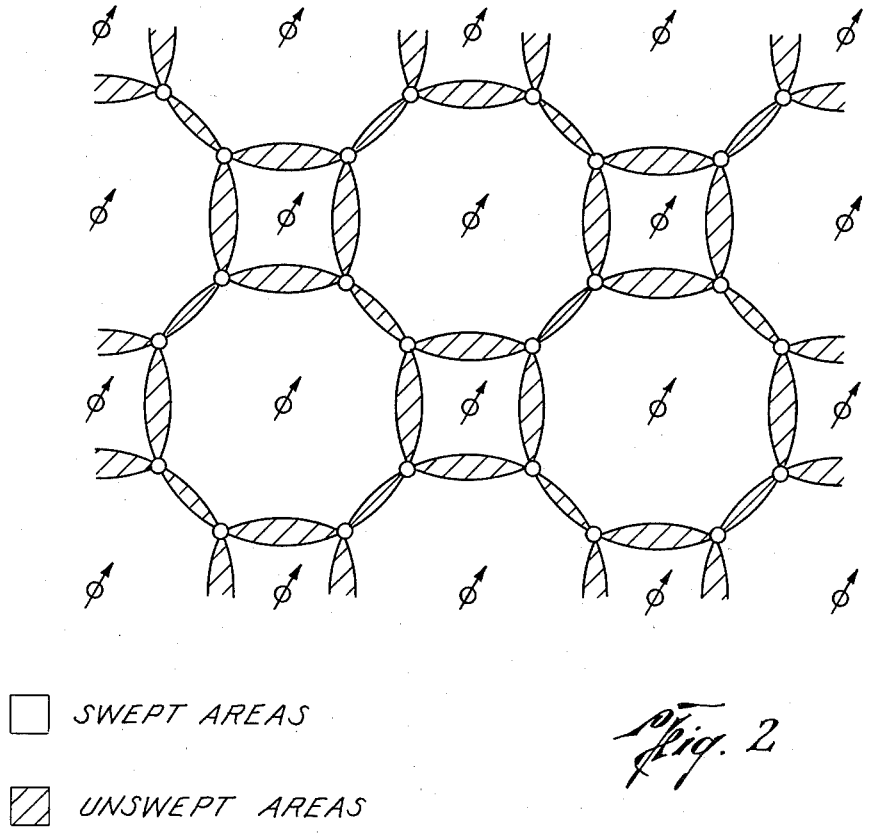
FIG. 2 portrays in plan view a plurality of the square grid units within the larger square grid pattern with the two additional production wells drilled along the diagonal in each square grid unit, showing also the swept and unswept areas within the pattern.

As mentioned above, many well patterns can achieve high areal sweep efficiencies; however, high areal sweep efficiencies alone, without concurrently considering vertical sweep efficiency can result in a low overall efficiency for the enhanced oil recovery program.

The main problem resulting in low vertical sweep efficiencies is that of gravity segregation. This gravity segregation effect is caused by the difference in density between the relatively high density petroleum present within the reservoir and the relatively low density displacing fluids injected into the reservoir for the recovery of the petroleum. This is the phenomenon known as override. One method that has been found effective to decrease the detrimental effect of this override phenomenon is to increase the ratio of the horizontal to the vertical velocity of the injected fluid. One way of accomplishing this effect is to maximize the injection rate of the injected fluid. Nonetheless, in most instances, the maximum injection rate for a field will be determined by the maximum production rate of the producing wells. For this reason, it is usually advantageous to increase the ratio of producing to injection wells if the desired injection rate increase is to be accomplished.

To these ends we have discovered an effective modification of the standard square grid well pattern which will produce a favorable production to injection well ratio. This modification comprises converting the four wells on the perimeter of the square grid unit into injection wells and drilling two additional wells along one diagonal of each square grid unit and employing these two wells as production wells. By adjusting the position of the two additional wells along the diagonal and/or the injection rates of each of the corner wells simultaneous breakthrough of the injected fluids can be achieved at the production well with the attendant benefits of increased oil production and decreased pattern life. The two additional production wells in one square grid unit are positioned on the opposite diagonal from that of the grid unit immediately adjacent said grid unit in that particular row or column.

Since this improved well pattern required the drilling of two additional producing wells within each grid unit, this improved well pattern represents an added expense when compared to other conventional well patterns such as the five spot configuration. This improved well pattern, however, gives greatly increased oil recoveries over the conventional five spot pattern. As mentioned above, a five spot pattern comprises a conventional square grid unit with the four wells at the perimeter of the square grid being utilized as injectors with a central producing wells within each unit. The comparison between the improved well pattern and the conventional five spot pattern was accomplished by both a computer simulation for the areal sweep comparison and field data correlations for the vertical sweep efficiency comparison.

The field study correlation was done on the basis of a field study performed in the San Ardo Field, Monterrey, California, which examined the relationship between steam injection rate and vertical sweep efficiency. A distinction was made between a primary steam swept thickness, $h_p$, swept to a primary steam swept oil saturation, $S_{orp}$, and a secondary steam swept thickness, $h_s$, swept to a secondary steam swept oil saturation, $S_{ors}$. The residual oil saturation as determined in the field averaged 0.115 and 0.37 in the primary and secondary swept regions, respectively. The primary swept thickness, as determined by the correlation of field data, was given by the following:

$$h_p = 0.0291 Q_s$$

where $h_p$ is in meters and $Q_s$ is the steam injection rate as water in $m^3/d$.

The secondary steam swept thickness is assumed to be given by the following:

$$h_s = \frac{(S_{oi} - S_{ors})(H_t - h_p)}{(S_{oi} - S_{orp})}$$

where $S_{oi}$ is the initial oil saturation and $H_t$ is the total formation thickness. Then the total swept thickness, h, is given by:

$$h = h_p + h_s = \frac{(S_{oi} - S_{ors})H_t}{(S_{oi} - S_{orp})} + \left(1 - \frac{S_{oi} - S_{ors}}{S_{oi} - S_{orp}}\right)(0.0291 Q_s)$$

This total swept thickness is swept to an average saturation that is given by:

$$S_{or} = \frac{(S_{orp})(h_p) + (S_{ors})(h_s)}{h}$$

Measurements for the particular pattern in the San Ardor Field yielded values for $S_{orp}$ and $S_{ors}$ of 0.115 and 0.37 respectively, with 0.689 for $S_{oi}$ and 38 meters for the total formation thickness h. Solving for h and $S_{or}$ in terms of $Q_s$ produces the following two equations.

$$h = 17.170 + (1.2215)(10^{-2})Q_s$$

and $$S_{or} = (0.3483) - (2.7256)(10^{-4})Q_s$$

The pattern response is equivalent to sweeping a layer of thickness h to a residual oil saturation of $S_{or}$. It should be noted that the dependence of $S_{or}$ on $Q_s$ in the above equation occurs because of the distinction made above between the primary and secondary swept zones. It does not indicate that displacement efficiency depends on injection rate.

Assuming a pattern area of 2 ha., a porosity of 0.386, and a maximum producing rate per well of 300 $m^3/d$, along with the values and functions previously defined, a comparison of oil recovery between improved pattern disclosed herein and the conventional five spot pattern can be made for this pattern, the total oil in place prior to steam injection is:

$$N = \tfrac{1}{4}10^4 m^3/(ha)(m)\tfrac{1}{2}(0.386)(2ha)(38m)(0.689) = (2.02)(10^5)m^3.$$

The areal sweep efficiency of a conventional five spot pattern is known to be about 71% for a producing rate per well of 300 $m^3/d$. The injection rate per injector will be 300 $m^3/d$ (assuming balanced injection and production), since the number of the injectors equals the number of producers for a fully developed five spot well pattern configuration. From the assumed functions above are obtained values of:

$$S_{or} = 0.267$$

$$h = 20.83 \text{ m.}$$

This will result in a total oil recovery of:

$$N_p = \tfrac{1}{4}10^4 m^3/(ha)(m)\tfrac{1}{2}(0.386)(0.71)(ha)(20.83m)(0.689 - 0.267) = (0.48)(10^5)m^3.$$

The total recovery efficiency for the conventional five spot pattern is then:

$$h_t = \frac{N_p}{N} = \frac{0.48}{2.02} = 0.238.$$

The same analysis was then applied to the improved pattern disclosed herein. First, a computer simulation was run for the improved pattern with the two additional producing wells positioned along a diagonal of the individual unit such that the diagonal is divided into three segments of equal length. Simultaneous breakthrough by the injected fluid from both sets of injectors at the producing wells was achieved by injection rates of 288 $m^3/d$ for the two injectors closest to the producers and 912 $m^3/d$ for the two farthest from the producers. It should be noted that now the average injection rate per injection well is 600 $m^3/d$ since there are now 2 producers per injector for the improved pattern, as opposed to one producer per injector for a conventional five spot pattern. The computer simulation indicated that the areal sweep efficiency for the improved pattern was 79% as compared to 72% for the conventional five spot pattern. Of the total area swept, 24% was swept by the two injectors whose injection rate was 288 $m^3/d$ and 76% by the two injectors whose injection rate was 912 $m^3/d$. The proportion swept by each is simply proportional to the relative injection rates. For the two wells injecting at 288 $m^3/d$ then:

$$A_s=(0.79)(2ha)(0.24)=0.38\ ha$$

$$h=17.170+(1.2215)(10^{-2})(288)=20.69\ m$$

and $$S_{or}=0.3483-(2.7256)(10^{-4})(288)=0.270$$

for the two wells injecting at 912 $m^3/d$:

$$A_s=(0.79)(2ha)(0.76)=1.20\ ha$$

$$h=17.170+(1.2215)(10^{-2})(912)=28.31\ m$$

and $$S_{or}=0.3483-(2.7256)(10^{-4})(912)=0.100.$$

The total amount of oil recovered by the improved pattern is then:

$$N_p = \tfrac{1}{4}10^4 m^3/(ha)(m)\tfrac{1}{2}(0.386)(0.38ha)(20.69m)(0.6890.270) + \tfrac{1}{4}10^4 m^3/(ha)(m)\tfrac{1}{2}(0.386)(1.20ha)(28.31m)(0.689 - 0.100) = (0.90)(10^5)m^3.$$

This gives a total recovery efficiency of:

$$h_t = \frac{N_p}{N} = \frac{0.90}{2.02} = 0.446.$$

Under these conditions the improved well pattern will recover almost twice as much petroleum as the conventional five spot pattern. However, an argument might be raised that since it would be more expensive to drill the additional well necessary for the improved well pattern disclosed herein over the single producing well utilized in a conventional five spot pattern, that it may well be more effective to merely increase the producing capacity of the single producing well in a conventional five spot pattern. To this end, the analysis was repeated for a conventional five spot pattern, assuming that the producing capacity of the central production well could be doubled to 600 $m^3/d$ or with an accompanying increase in the injection rate to 600 $m^3/d$. By the analysis above are obtained the values of:

$$S_{or}=0.185$$

and $$h=24.50\ m.$$

The value for the total oil recovered will then be:

$$N_p = \tfrac{1}{4}10^4 m^3/(ha)(m)\tfrac{1}{2}(0.386)(0.71)(2ha)(24.50)(0.689 - 0.185) = (0.68)(10^5)m^3.$$

Solving finally for the recovery efficiency:

$$h_t = \frac{N_p}{N} = \frac{0.68}{2.02} = 0.337.$$

Therefore, even with the analysis that assumes the same producing capacity for the conventional five spot pattern as for the improved pattern, the improved pattern is much improved over the conventional five spot pattern.

The preferred embodiment discussed above utilized a configuration for the improved well pattern wherein the two additional wells were spaced equidistantly along the diagonal in the single square grid unit. Other spacings are possible and in some situations may be desirable. Nonequidistant spacings could be utilized if, for example, one of the four wells at the corners of the square grid unit had a significantly different injection rate than that of the other wells in the square grid unit. Such variations are within the scope of this invention, but are best left to the judgment of the experienced practioner in the field.

The preferred embodiment discussed above and its variations are presented for the purpose of illustrating the best mode contemplated for use of the invention, but should not be considered as limitative. The full scope of the invention is defined in the claims below.

We claim:

1. In an enhanced oil recovery process utilizing a plurality of wells disposed in a nearly square grid well pattern where the plurality of the wells are utilized as injection wells to inject a fluid into a petroleum reservoir, said fluid being then forced through the reservoir toward a plurality of production wells from which the fluid and mobilized petroleum from the reservoir are produced, the improvement comprising utilizing the wells at the corners of each nearly square grid unit as injection wells, drilling two additional wells within each square grid unit along only one diagonal of each nearly square grid well pattern, opposite diagonals being utilized from one grid unit to the next within both rows and columns within the nearly square grid well pattern, said two additional wells in each nearly square grid well pattern being spaced thereupon such that a high areal sweep efficiency for the well pattern is achieved, and utilizing these two additional wells as new production wells within each square grid unit.

2. The process of claim 1, wherein the fluid comprises water.

3. The method of claim 1, wherein the fluid comprises steam.

4. The method of claim 1, wherein the spacing of the two additional wells along said diagonal in each square grid unit is such that the spacing of the wells divides the diagonal into three nearly equal segments.

* * * * *